US005112093A

United States Patent [19]

Kindling

[11] Patent Number: 5,112,093

[45] Date of Patent: May 12, 1992

[54] GOLF BALL RETRIEVER

[76] Inventor: Alexander T. Kindling, 5619 Kentucky Ave., Pittsburgh, Pa. 15232

[21] Appl. No.: 751,874

[22] Filed: Aug. 28, 1991

[51] Int. Cl.[5] ..... A63B 47/02

[52] U.S. Cl. ..... 294/19.2; 273/162 E

[58] Field of Search ..... 294/1.1, 19.1, 19.2, 294/99.1; 56/328.1; 273/32 F, 32 D, 162 E, 162 F

[56] References Cited

U.S. PATENT DOCUMENTS

| | | | |
|---|---|---|---|
| 1,722,519 | 7/1929 | Du Chene | 294/19.2 |
| 2,448,644 | 9/1948 | Williams | 294/19.2 |
| 2,524,527 | 10/1950 | Jasmer | 294/19.2 |
| 2,561,815 | 7/1951 | Oberg | 294/19.2 |
| 2,802,687 | 8/1957 | Du Chene | 294/19.2 |
| 3,058,767 | 10/1962 | Baker | 294/19.2 |
| 3,210,111 | 10/1965 | Fallon | 294/19.2 |
| 3,520,569 | 7/1970 | Anderson | 294/19.2 |
| 3,712,658 | 1/1973 | Yaresh | 294/19.2 |
| 3,743,338 | 7/1973 | Seeger | 294/19.2 |
| 3,749,407 | 7/1973 | Prochnow | 294/19.2 X |
| 3,810,669 | 5/1974 | Reid | 294/19.2 |
| 3,997,169 | 12/1976 | Bergstrom | 294/19.2 X |
| 4,687,204 | 8/1987 | Lempio | 294/19.2 X |

FOREIGN PATENT DOCUMENTS

| | | | |
|---|---|---|---|
| 216731 | 6/1924 | United Kingdom | 294/19.2 |

*Primary Examiner*—Johnny D. Cherry
*Attorney, Agent, or Firm*—Clifford A. Poff

[57] ABSTRACT

Disclosed is a golf ball retriever for use with the head of an iron golf club and formed of a continuous coil of high strength metal wire, the coil having an outer end and with convolutions that are slightly larger in diameter than that of the ball, in which the convolutions become progressively smaller in diameter as the coil extends to the inner end where the inner most convolution is slightly smaller than the diameter of the ball, to allow the ball to be retrieved thereby as it is urged inwardly into the retriever, the two inner most convolutions being formed so that they can be forced over the head, in which the head is squeezed between the last two convolutions at the inner end and in which the end of the coil fits around and against the bottom or back portion of the head.

17 Claims, 2 Drawing Sheets

GOLF BALL RETRIEVER

BACKGROUND OF THE INVENTION

The present invention relates to a retriever for golf balls when situated, for example, in lakes, ponds, ditches or other difficult or inaccessible places to reach by hand.

For such purposes there is presently on the market telescoping rod like handles with ball retrieving elements mounted on their ends. These devices which are normally carried by the golfer in his or her bag along with the clubs add weight and take up space in the bag and not only are relatively expensive, but require that the retriever, which may take the form of a cup like member, be manipulated beneath the ball to lift the ball out of the inaccessible place.

Other forms of known golf ball retrievers have sought to eliminate the handle devices and the need to carry a separate weighty and cumbersome device in the golfer's bag by providing a device that can be placed by the golfer on the head of a golf club, either a wood or iron type club, and after use removed therefrom for storage in a pocket of the golf bag.

These later devices have taken many forms, such as the use of coil spring like devices, wire or solid material cradles, and cup like members, all of which possess one or more disadvantages. Some of the disadvantages are the degree of difficulty to use, the mode of attachment to the club, the largeness of the device, the fact that the parts that actually engage the lost ball extend downwardly away from the bottom of the club, in which, in some cases require that a space exist under the ball to accommodate the device before the ball can be captured.

SUMMARY OF THE INVENTION

The present invention has for its object to provide a golf ball retriever which will overcome each of the above disadvantages and limitations and others and that will be inexpensive to manufacture, be very compact in design and one that can be very readily attached to the head of an iron club and held securely in place until removed for storage in a pocket of the golf bag. The retriever constructed in accordance with the invention also allows it to be used as a device for picking up golf balls from the ground, for example, practice balls.

Another object of the invention is to provide a golf ball retriever for use with the head of an iron club that is formed of a continuous coil of high strength wire, such as a spring or stainless steel, the coil having an outer end with convolutions that are slightly larger in diameter than that of the ball and in which the convolutions become progressively smaller in diameter to a diameter slightly less than the diameter of the ball to allow the ball to be held thereby as it is urged inwardly into the retriever, the two inner most convolutions being formed so that they can be forced over the head of the club so that the head is squeezed between the last two convolutions and in which the inner end of the coil fits around and against the head A further object of the invention is to provide that the coiled wire is made of stainless steel, plastic or fiberglass and/or coated with TEFLON (polytetrafluorethylene) or a like material to reduce the risk of scratching of the club head and oxidation of the retriever.

A still further object of the invention is to provide a golf ball retriever for use with the head of an iron golf club comprising a coil of continuous wire like material having a number of spaced apart convolutions and having a substantial degree of resistance against expansion of its convolutions, the coil having a ball receiving end and an opposite club head attachment end, at least several of the convolutions of the receiving end having diameters slightly greater than the golf ball to be retrieved, the diameters of said convolutions progressively becoming smaller from the first convolution of the receiving end to the attachment end, where at least the first convolution at the attachment end is slightly small than the diameter of the ball, the axial distance formed by a number of several convolutions starting with the first convolution at the receiving end, being such that the distance substantially equals the diameter of a ball to be retrieved, the first two convolutions of said attachment end forming a decreasing space condition therebetween such that the end of said coil at this end has a substantially closer relationship to the next adjacent convolution than at least some of said other convolutions, this closer relationship forming a gripping relationship with the club head, the end of said coil at the attachment end being formed to forcibly contact the club head, whereby the first two convolutions can be quickly inserted from the bottom or top of the club head and around/or against the head to be securely held by the first two convolutions and the end of the coil at the attachment end, with a portion of the retriever extending generally perpendicularly to the lower portion of the face of the club head.

DESCRIPTION OF THE DRAWINGS

These objects and advantages, as well as others, will be better understood when the following description is read along with the accompanying drawings, of which.

DETAIL DESCRIPTION OF THE INVENTION

Figure 1:
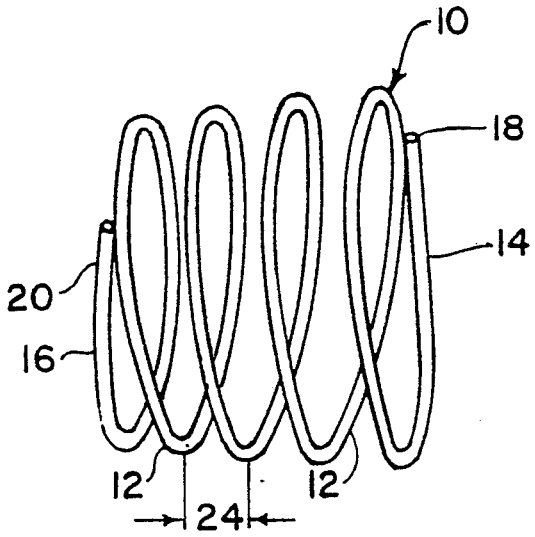
FIG. 1 is a perspective view of a golf ball retriever constructed in accordance with the present invention.
Figure 2:
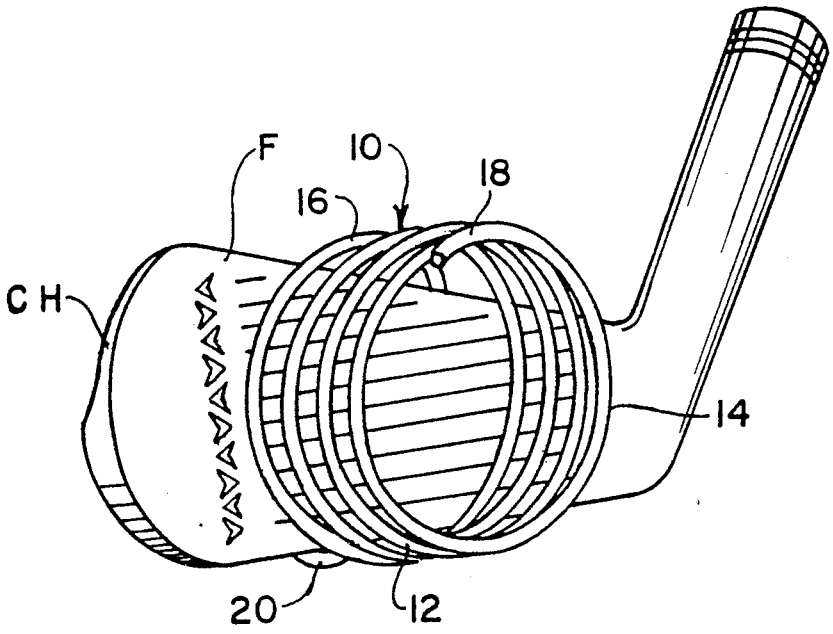
FIG. 2 is an elevational view of the retriever shown in FIG. 1 attached to a head of an iron golf club shown in outline form.

With reference to FIGS. 1 and 2, the retriever comprises a continuous spiral ring or coil 10 of wire like material having five spaced apart convolutions 12, the coil being made out of well known spring steel, for example, which will have a relatively high resistance against expansion. By referring to wire, it is to be understood to include other cross-sectional shapes than circular, such as strip like, oval and rectangular. The coil is formed with a ball receiving side 14 and a club head C-H attachment side 16, the end 14 being made slightly larger than the diameter of the ball, while the end 16 is made slightly smaller than the diameter of the ball, FIG. 2 showing this in exaggerated form. The diameter of an "American" ball is 1.68 inches and that of an "English" ball is 1.62 inches.

The two ends 18 and 20 of the coil 10 are formed to assume a close relationship to the next adjacent convolutions, in which they are formed to preferably touch the first convolution at each end and also so that the first convolution has only a slight difference in diameter with respect to the next adjacent convolution thereby providing a generally even "floor" condition 22 for the ball as it is urged into the retriever. In a different form the convolutions need not be "tapered" inwardly, and may have a more or less uniform diameter.

The coil 10 has an axial length so that when mounted on the head of the club C-H, the several convolutions extending from the face side F of the club will create a length substantially equal to the diameter of the ball, this length or distance including the several spaces or openings 24 between the several convolutions 12. In another form of the invention, the convolutions may assume a close relationship with little or no openings and the axial distance may be less than the diameter of the ball.

The coil illustrated is formed from a continuous spring steel wire having a gauge of approximately 0.100. The material can be stainless steel to avoid rusting of the metal or the metal can be provided with a coating of plastic or similar material such as TEFLON (polytetrafluorethylene), or at least the end 20 can be coated to prevent the tendency of the end to scratch the club head. Instead of the given thickness, which in spring steel is highly resistance against expansion, a thinner metal may be used in order to make it easier to mount the retriever on the head, since to do this the retriever must be forced over the bottom or top of the head with the face of the head facing the retriever, as shown in FIG. 2. Also the material of the coil can be a plastic or fiberglass.

It is a feature of the invention to provide a means for allowing the retriever to be quickly mounted on the club head C-H and after mounting to hold it securely to the head, and after use to permit the retriever to be quickly removed. This is accomplished by providing at least a portion of the first convolution and preferably the first two convolutions at the attachment end 16 to be such that the head is held securely against these convolutions. As noted above, it is preferred that the ends 16 and 18 be in a touching relationship with their adjacent convolutions. In addition, the end 20 is adapted to either encircle the flat surface of the top or bottom of the head or to engage the back of the head, depending on whether the head has a narrow face, as would a No. 1 iron club or a wide face as would a No. 9 iron club. In either case, the end 20 tends to forcibly squeeze and grip the head between the two convolutions and when the contact of the convolutions and end 20 contact is slightly released during the initial stage of removing the retriever from the head, further movement of the end 20 allows the retriever to be quickly removed from the head.

Figure 3:
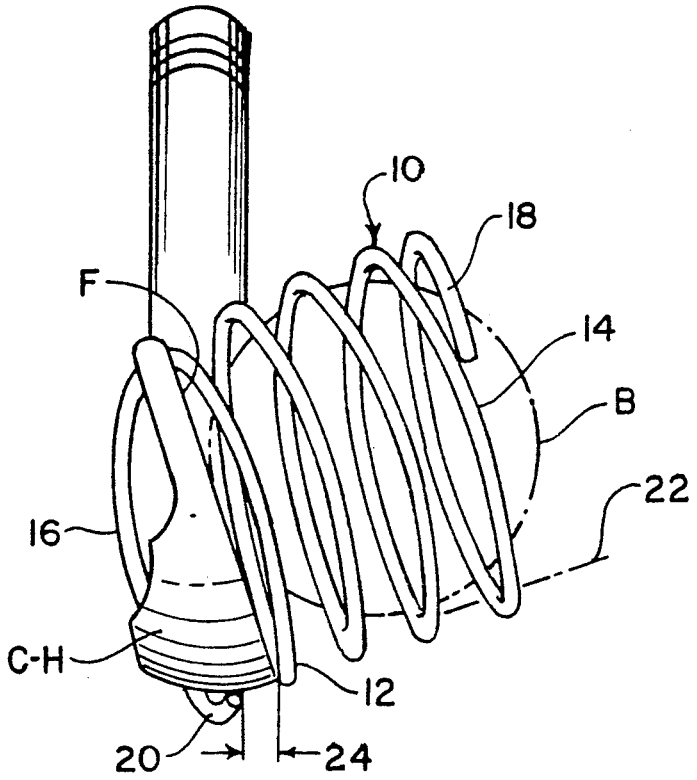
FIG. 3 is an end view of the retriever shown in FIG. 2.

Depending on the type of iron club to be used with the retriever, for example a non-cavity back club or a cavity back club, the golfer may find one numbered club of his or her set of iron clubs to be more ideally suited than one of the others, for example the No. 5 iron club having a non-cavity back of a "traditionally" shaped head where the end 20 fits over the top of the head and the bottom of the retriever is in close axial alignment with the bottom of the head as it projects away from the face of the head. In FIGS. 2 and 3, the retriever has been fit on the head from the top in which the final half of the convolution is shown to extend across the back of the club head and top with the end 20 abutting against the bottom or flange of the head which relationship is best shown in FIG. 3. The opposite relationship will take place when the retriever is mounted from the bottom of the head. This is particularly preferred when the height of the face of the head will place the bottom of the retriever at the bottom of the head.

As noted, the retriever is mounted at the face F of the head and extends from the bottom thereof. When so mounted, the retriever can be moved to the center of the head. This will permit better control in manipulating the shaft to retrieve a ball and to assure that the retriever will not inadvertently slide off the head when brought into contact with the ball. When so mounted, the retriever will project away from the face F of the head with its lower portion either slightly below or even with the bottom or flange of the head as can be seen best from FIGS. 2 and 3.

Once the retriever is so mounted, the golfer need only manipulate the club from the top of its shaft so that the ball B is forced to pass into the receiving end 14 until the inner-most portion of the ball contacts the face F of the club head C-H, which face is exposed on the inner side of the second convolution 12 of the attachment end 20. Once the ball is retrieved by the retriever, it can be lifted out of the inaccessible place or off the ground by simply lifting the club shaft to which the retriever is attached. After this, the retriever can be quickly removed from the head by, for example, holding the head in one hand and the retriever in the other and pulling the retriever from the head. The retriever can also be removed from the head by simply twisting the coil to cause it to "unwind" from the head. The retriever can than be put in a pocket of the golfer's bag.

While the present invention has been described in accordance with the preferred embodiment and certain modifications have been referenced, it is to be understood that other similar embodiments may be used or other modifications and additions may be made to the described embodiment for performing the same or similar functions of the present invention without deviating therefrom. Therefore, the present invention should not be limited to any single embodiment but rather construed in breadth and scope in accordance with the recitation of the appended claims.

I claim:

1. A golf ball retriever for use with the head of an iron golf club having a ball striking face and a side opposite the face comprising:

a coil of continuous wire like material having a number of convolutions and having a substantial degree of resistance against expansion of its convolutions, said coil having a ball receiving end section and an opposite club head attachment end section, at least several of the convolutions of said receiving end section having diameters greater than the diameter of the ball to be retrieved, the axial distance formed by several of said convolutions starting with the first convolution at said receiving end section being such that the ball may be supported by at least several of said convolutions, said attachment end section terminating into a free unattached end, said attachment end section also having a portion that tightly wraps around the face and the side opposite the face of the club head, in a manner that said unattached end forcefully engages the head, to establish a strong gripping relationship between the retriever and the club head, and in a manner that the retriever may be quickly placed on the club head in a position extending generally perpendicular to the club head in a position to retrieve a ball.

2. A golf ball retriever according to claim 1 wherein said convolutions are sufficient in number to cause the ball to be supportable by several convolutions.

3. A golf ball retriever according to claim 1 wherein said coil has an outer coating resistant to oxidation.

4. A golf ball retriever according to claim 1 wherein said attachment end section consists of at least the first two convolutions at said attachment end section.

5. A golf ball retriever according to claim 1 wherein at least some of said convolutions are spaced apart, and wherein the first two convolutions at said attachment end section form a decreasing space condition therebetween such that said two convolutions have a substantially closer relationship to the next adjacent convolution that at least some of the other convolutions, wherein said closer relationship forms a gripping relationship with the club head.

6. A golf ball retriever according to claim 5, wherein said axial distance includes the spaces between said convolutions.

7. A golf ball retriever according to claim 1, in combination with the golf club wherein the golf club and retriever have bottom portions and said receiving end section of the retriever is adapted to be placed on the face of the club head and as so placed the bottom portion of the retriever extends from the bottom portion of the club head.

8. A golf ball retriever according to claim 1, wherein said coil has an outer coating of TEFLON.

9. A golf ball retriever according to claim 1, wherein said coil is formed of spring steel.

10. A golf ball retriever according to claim 1, wherein said coil is formed of stainless steel.

11. A golf ball retriever according to claim 1, wherein said unattached end of said attachment end section has a covering to resist scratching of the head.

12. A golf ball retriever according to claim 1, wherein the diameter of said receiving end section of said coil is slightly larger and the diameter of said attachment end section of said coil is slightly smaller than the diameter of the ball.

13. A golf ball retriever according to claim 1, in combination with the golf club wherein a portion of the retriever when mounted on the club head extends generally perpendicularly to a lower portion of the face of the club head.

14. A golf ball retriever according to claim 1, in combination with the golf club wherein said convolutions at said attachment end section are of a diameter that the ball is restricted in its movement into the retriever by the face of the club head.

15. A golf ball retriever according to claim 1, wherein said diameters of said convolutions progressively become smaller from the first convolution of said receiving end section to said attachment end section.

16. A golf ball retriever according to claim 1, wherein said degree of resistance against expansion is sufficient to permit convolutions in contact with the head to securely hold the retriever to the head.

17. A golf ball retriever according to claim 1, wherein at least the first convolution at said attachment end section is smaller in diameter than the diameter of the ball to be retrieved, and wherein said distance substantially equals the diameter of the ball to be retrieved.

* * * * *